US006308846B1

(12) United States Patent
Müller

(10) Patent No.: US 6,308,846 B1
(45) Date of Patent: Oct. 30, 2001

(54) DOUBLE-WALLED BOTTLE

(75) Inventor: Linda Müller, Massagno (CH)

(73) Assignee: Thewi Holding B.V., Amsterdam (NL)

( * ) Notice: Subject to any disclaimer, the term of this patent is extended or adjusted under 35 U.S.C. 154(b) by 0 days.

(21) Appl. No.: 09/230,281

(22) PCT Filed: Jul. 18, 1997

(86) PCT No.: PCT/EP97/03845

§ 371 Date: Jan. 25, 1999

§ 102(e) Date: Jan. 25, 1999

(87) PCT Pub. No.: WO98/04477

PCT Pub. Date: Feb. 5, 1998

(30) Foreign Application Priority Data

Jul. 25, 1996 (CH) ..... 1855/96

(51) Int. Cl.[7] ..... A61J 9/00

(52) U.S. Cl. ..... 215/13.1; 215/12.1; 220/592.27; 220/592.17

(58) Field of Search ..... 206/524.8; 215/13.1, 215/12.1; 220/592.27, 592.17, 592.26

(56) References Cited

U.S. PATENT DOCUMENTS

| | | | | |
|---|---|---|---|---|
| 1,199,772 | * | 10/1916 | Engel | 215/12.1 X |
| 1,525,567 | * | 2/1925 | Cadby | 215/12.1 X |
| 1,706,034 | * | 3/1929 | Moore | 215/12.1 |
| 2,666,979 | * | 1/1954 | Van Dusen | 215/12.1 X |
| 3,120,570 | * | 2/1964 | Kennedy et al. | 215/12.1 |
| 3,295,709 | * | 1/1967 | Herrick et al. | 215/12.1 X |
| 3,482,724 | * | 12/1969 | Heaton | 215/12.1 X |
| 3,766,975 | * | 10/1973 | Todd | 215/12.1 |
| 3,952,898 | * | 4/1976 | Bayer | 215/12.1 X |
| 4,273,245 | * | 6/1981 | Hartinger-Machalek | 215/12.1 X |
| 4,460,090 | * | 7/1984 | Paoletti | 215/386 X |
| 4,595,437 | * | 6/1986 | Yamamoto | 220/592.27 X |
| 5,462,180 | * | 10/1995 | Bright | 215/386 X |
| 5,693,425 | * | 12/1997 | Ma et al. | 428/483 |
| 5,901,882 | * | 5/1999 | Siegel | 215/229 X |

OTHER PUBLICATIONS

Wiley Encyclopedia of Packaging technology, 1986.*

* cited by examiner

*Primary Examiner*—Allan N. Shoap
*Assistant Examiner*—Tri M. Mai

(57) ABSTRACT

A bottle with thermally shielded body, comprising a first component which forms a tubular internal body having a closed bottom, an upper neck with an opening for filling and pouring a beverage, and, between the body and the neck, an annular region for coupling to the upper edge of a second component which is coaxial to the first one and forms an external tubular body which has a closed bottom and forms an interspace together with the tubular body of the first component.

10 Claims, 4 Drawing Sheets

DOUBLE-WALLED BOTTLE

BACKGROUND OF THE INVENTION

The present invention relates to a bottle with thermally shielded body.

It is known that white wines, particularly sparkling and effervescent wines, must be kept at low temperature, in the order of ten degrees above zero.

This occurs essentially because of some particular requirements which are typical of these wines: a first one is technical and is linked to the fact that at high temperatures, when the bottle is uncorked, there is a considerable escape of gas and beverage; a second one is organoleptic and is linked to the fact that the gas contained in the wine must be retained in it as much as possible so that its taste and fragrance are optimum for consumption (at high temperature, the gas tends to escape when the bottle is opened); and a third one which is caused by the fact that the opening shock, and therefore the stirring of the wine when the cork exits, must be as small as possible, especially if there is sediment on the bottom of the bottle.

For such reasons, before drinking sparking and effervescent white wines it is customary to chill the bottles in a refrigerator and then place them in containers, such as ice buckets or insulated thermal containers, commonly known as isothermic bucket, in order to reduce the coefficient of heat exchange with the outside.

These requirements are also felt, albeit to a lesser extent, for red wines, for which the optimum drinking temperature is higher (slightly lower than room temperature) and therefore in these cases, too, the use of isothermic buckets can be important.

Similar problems can in any case be observed for other beverages, particularly carbonated ones or more generally for all liquids which, after being preserved at low temperature, are left at room temperature for a certain period of time.

Containers of various shapes are already known which are thermally shielded by virtue of the presence of a double wall which forms an interspace along their entire extension, but the embodiments are particularly constructively complicated and entail long and troublesome production methods which are unsuitable for large-scale industrial manufacturing and for providing a product which is commercially competitive, in view of the low cost that characterizes the bottles commonly used to contain wines.

Containers made of ceramic or porcelain are also known which comprise an inner vessel, which is substantially bottle-shaped and thus has a hollow body with a closed bottom and an upper shaping which forms a tapered portion that ends with a mouth for introducing or pouring a liquid, and an outer vessel, which encloses the body of the inner vessel and is gently blended and monolithically joined thereto in the region where tapering begins.

The two containers are first produced as prebaked semi-finished parts and are then assembled, glazed and subjected to final baking.

In this case, too, the process is long and work-intensive and in any case the containers are not suitable for use to contain wines for a long time, because the shape and the materials (ceramic and porcelain) do not allow corking of the upper mouth, which entails forcing the insertion of the cork in the upper mouth with an axial force of up to 140 kg, and also because they are not suitable to withstand, in the case of sparkling wines, the internal pressures that develop over time before consumption.

Such containers can be used to contain beverages poured into them shortly before consumption.

FR-A-1 552 060 discloses a bottle with a base adapted for supporting the bottom of the bottle and for being used as a drinking cup by receiving liquid from the bottle. In certain cases, the base may provide a thermal insulation for the bottle.

GB-A-1 197 596 discloses a bottle which has a cup preferably formed of thin-walled plastics material removably fitted over the bottom portion of the bottle for receiving the liquid contents of the bottle.

SUMMARY OF THE INVENTION

The aim of the present invention is to provide a bottle which is already in itself thermally shielded with respect to the outside environment, so that once it is removed from a refrigerated space it can maintain a low temperature of its contents for a long time.

Within the scope of this aim, a consequent primary object is to provide a bottle which eliminates the use of buckets, isothermic buckets, and other containers which are less practical in wine consumption.

Another important object is to provide a bottle whose external shape is not substantially different from that of known bottles used for containing wines or beverages in general.

Another object is to provide a bottle which is structurally simple and can be produced without particular technical complications.

Another object is to provide a bottle which can be obtained by using known equipment.

Another object is to provide a bottle whose cost is commercially competitive.

Last but not least it is an object of the invention to prevent the labels of producers from being covered by buckets or isothermic buckets and therefore from being not clearly in view, as dictated by advertising and image-promotion requirements.

This aim, these objects and others which will become apparent hereinafter are achieved by a bottle, characterized in that it comprises a first component which forms an inner tubular body with a closed bottom, an upper neck with an opening for filling and pouring a beverage, with a rim which is shaped and enlarged with respect to the rest and, substantially between the body and the neck, an annular region for connecting to the upper rim of a second component which is coaxial to the first one and forms an outer tubular body which has a closed bottom and forms an interspace together with the tubular body of the first component, the coupling between said first component and said second component being provided through adhesives or by mutual localized fusion welding of the materials that compose them.

BRIEF DESCRIPTION OF THE DRAWINGS

Further characteristics and advantages of the invention will become apparent from the detailed description of a preferred and further embodiments of the invention, which are illustrated only by way of non-limitative example in the accompanying drawings, wherein.

DESCRIPTION OF THE PREFERRED EMBODIMENTS

Figure 1:
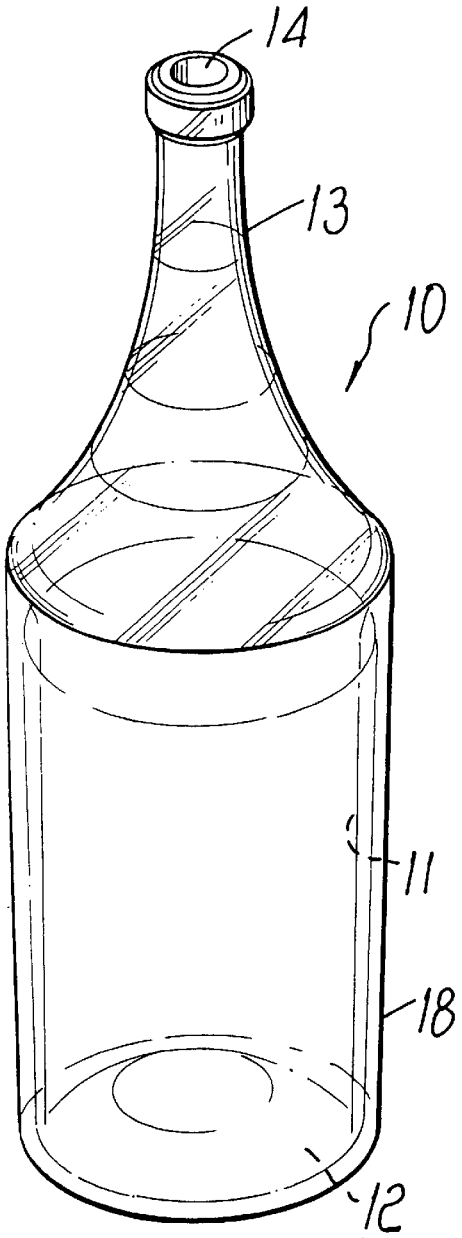
FIG. 1 is a perspective view of the bottle.
Figure 2:
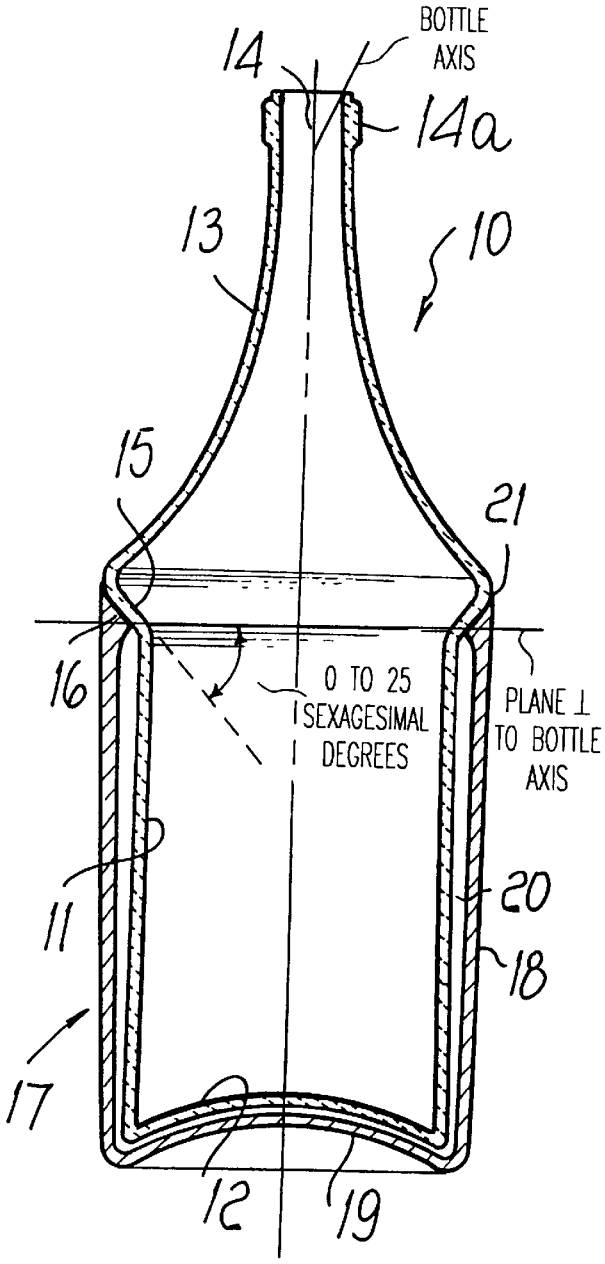
FIG. 2 is a sectional view of the bottle of FIG. 1.
Figure 2A:
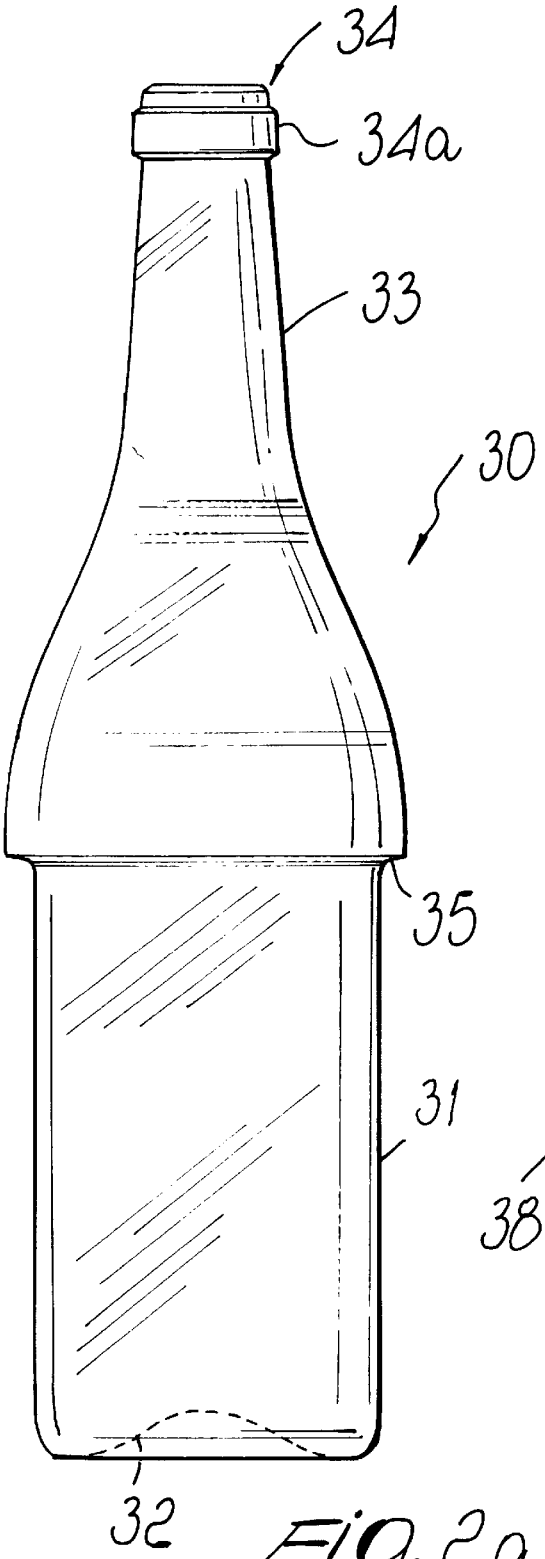
FIG. 2*a* is a view of the first component of a second embodiment of the bottle.
Figure 2B:
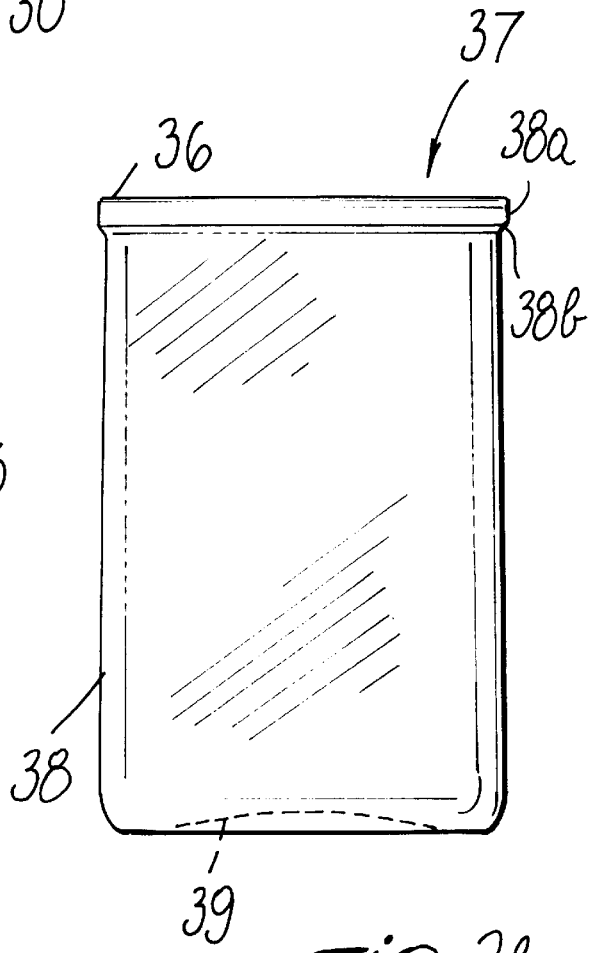
FIG. 2*b* is a view of the second component of the second embodiment of the bottle.
Figure 2C:
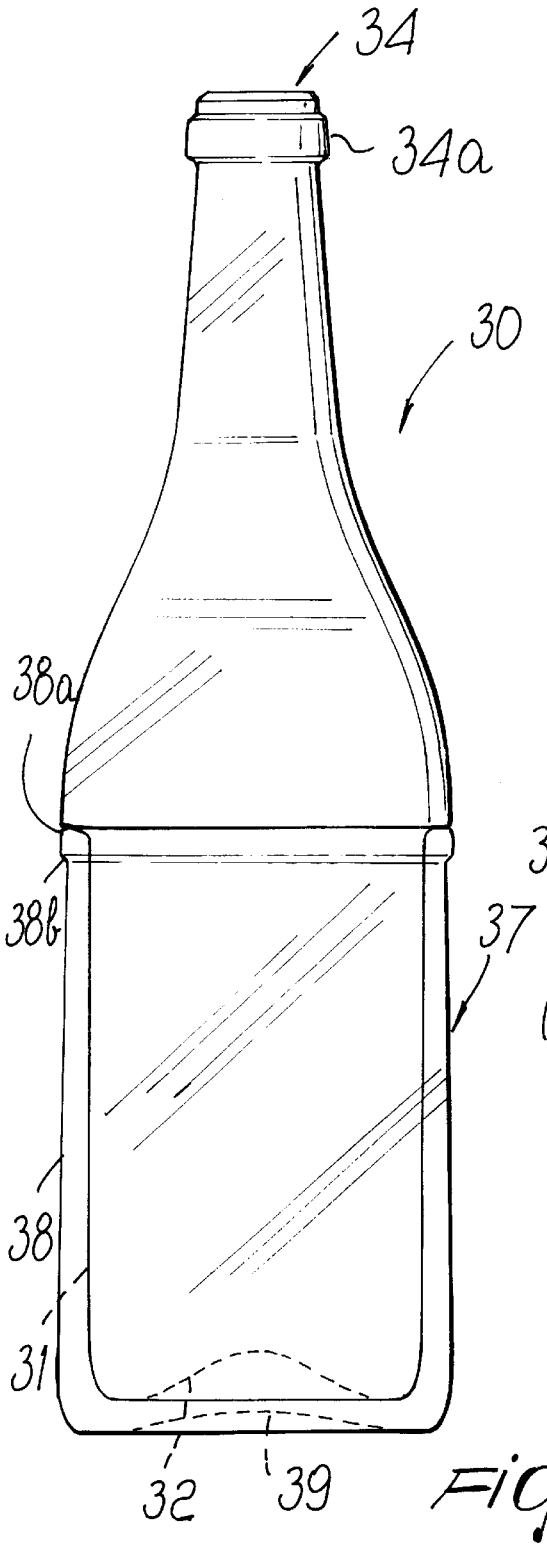
FIG. 2*c* is a view of the second embodiment of the bottle, shown assembled.
Figure 2D:
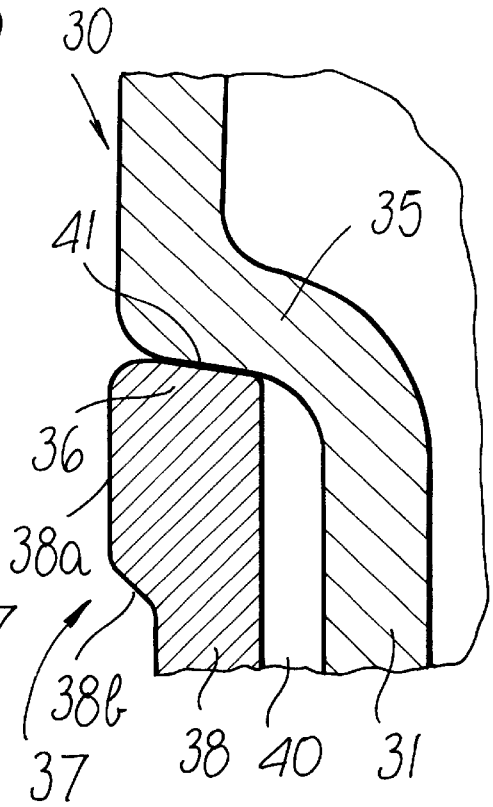
FIG. 2*d* is an enlarged-scale sectional view of a detail of the region for the mutual coupling of the first component of FIG. 2*a* and of the second component of FIG. 2*b;*

With reference to the above FIGS. 1 and 2, a bottle according to the invention, having a thermally shielded body, comprises, in a preferred embodiment, a first component 10 which forms a cylindrical tubular inner body 11, with a closed bottom 12 which is concave toward the inside, an upper neck 13, with an opening 14 for filling and pouring a beverage, and suitable to accommodate a cork, not shown (the rim 14*a* is conveniently shaped and enlarged for this purpose), and a conical annular flared portion 15 which connects the upper part of the body 11 to the lower part of the neck 13, said upper part having a smaller diameter than the second one.

The annular flared portion 15 constitutes an abutment for the upper edge 16, which is shaped complementarily and therefore flared, of a second component 17 which forms an outer tubular body 18, particularly a cylindrical one with a preferably concave closed bottom 19.

The second component 17 forms, together with the body 11 of the first component 10, an interspace 20 which is preferably filled with air but can also conveniently be filled with an insulating material or with highly heat-absorbing material, such as for example a glycol (a material which, when cooled for example so as to become solid, maintains low temperatures internally for a long time, at least until it returns to the fluid state).

The facing surfaces of the flared portion 15 and of the edge 16 are conveniently joined, preferably by gluing, with an appropriate silicone 21 or adhesive or by welding the materials as for instance by fusing the materials located in the regions of contact (for example flame welding).

The coupling must be perfectly hermetic in order to avoid the forming of condensate in the interspace 20.

The two components of the bottle, which before final assembly are in a physical state which does not require transformations for use, are both preferably made of glass, but can be conveniently made of other materials.

One component may be of one material and another component may be of a different material; for example, the first component 10 may be made of glass and the second component 17 may be made of aluminum or other metal joined to the first component proximate to the flared region 15.

With reference now to the above-cited FIGS. 2*a* to 2*d*, a bottle according to the present invention comprises, in a second embodiment entirely made of glass, a first component 30 which forms a cylindrical tubular inner body 31 which has an inwardly-concave closed bottom 32, an upper neck 33 with an opening 34 for filling and pouring a beverage and suitable to accommodate a cork, not shown, of the type commonly used for wines (the rim 34*a* is conveniently shaped and enlarged for this purpose), and a conical annular flared portion 35 arranged in the upper part of the body 31 adjacent to the lower part of the neck 33.

The annular flared portion 35 forms an abutment for the upper rim 36, which is shaped complementarily and therefore flared, of a second component 37 which forms an outer tubular body 38, particularly a cylindrical one, with a preferably concave closed bottom 39.

The outer tubular body 38, in particular, is provided at an upper portion with an annular rim 38*a* and a step like recess 38*b*, and extends from the latter by widening slightly towards the bottom. Its diameter at the bottom is equal to the diameter of the rim 38*a*. The recess 38*b* serves as a gripping element during operating phase.

The angle of the annular flared portion 35 with respect to a plane which is perpendicular to the axis of the bottle is preferably 10 sexagesimal degrees and is in any case between 0 and approximately 25 degrees.

This choice is due to a plurality of technical and constructive problems linked to the material and to the use of the bottle.

In a bottle, glass is in fact a material which excellently withstands axial loads and less effectively withstands radial loads.

With flaring angles greater than the above-mentioned ones, the axial force applied during corking (up to 140 kg for sparkling wines) is split, in the flared portion 35, into an axial component and a radial component; the value of said radial component is such as to even break the glass.

The optimum angle is zero degrees (which would eliminate the radial component), but production process requirements (with an angle of 0 degrees it is currently not possible to extract the first component 30 from the mold) have led to the choice of a compromise angle, which in particular provides for a radial component of the force which is 10% of the axial force.

As regards the problems related to use, it should be noted that all filled bottles, regardless of whether they contain sparkling wine or other wines, are stored by stacking in pallets and the pallets are in turn stacked even three or four high.

The bottles of the lower layer, located at floor level, must withstand the overlying load, which is never uniformly distributed.

The structure of the bottle must therefore ensure good seal not only in the most extreme case of sparkling wines but also in the other cases.

The second component 37 forms, together with the body 31 of the first component 30, an interspace 40 which is preferably filled with air but can also be conveniently filled with an insulating material or with a material which has a high heat-absorbing ability, such as for example a glycol (a material which, when cooled for example so that it becomes solid, maintains low temperatures internally for a long time, at least until it returns to the fluid state).

The facing surfaces of the flared portion 35 and of the rim 36 are conveniently joined, preferably by an elastomeric material or by gluing with an appropriate silicone 41 or an adhesive or by localized fusion welding of the materials in the contacting regions (for example flame welding).

Coupling must be completely hermetic to avoid the formation of condensate in the interspace 40.

The two components of the bottle, which before final assembly are in a physical state that does not require transformations for use, are both made of glass in this case, as mentioned.

Figure 3:
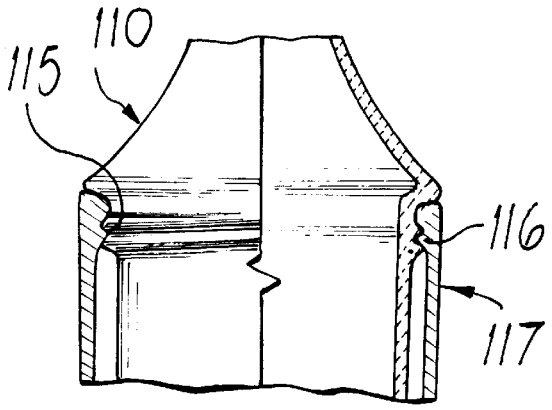
FIG. 3 is a view of a different embodiment of the bottle.

With reference now to the above FIG. 3, in a different embodiment the coupling between the first component 110 and the second component 117 is provided between a threaded annular region 115 of the first component 110 and the upper complementarily threaded edge 116 of said second component 117.

The coupling can be provided not only by simple screw coupling but also by adding adhesives; silicone or polyurethane are preferred among said adhesives.

In practice, the annular region 115 can be covered with silicone in the fluid state before polymerization, the edge 116 of the second component 117 can be screwed onto it, and then the assembly can be left to rest until the silicone polymerizes, joining and sealing the parts.

Figure 4:
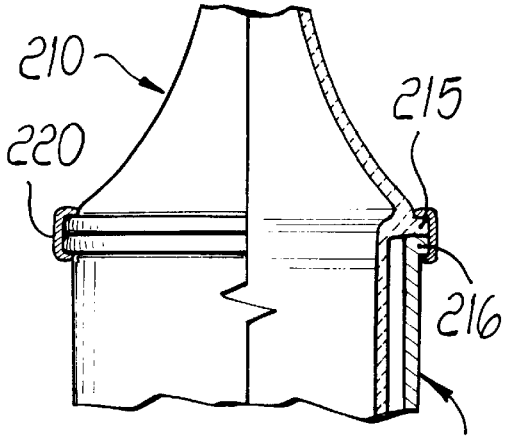
FIGS. 4, 5, 6 and 7 show further advantageous embodiments, in views similar to the one of FIG. 3.

With reference now to FIG. 4, in a further embodiment the coupling between the two components of the bottle is provided by associating with a strap 220 two annular raised portions, designated by the reference numerals 215 and 216 respectively: the first raised portion protrudes from the first component 210 and the second one protrudes from the second component 217.

The strap 220 covers, as a whole, both raised portions 215 and 216 and can be either elastic and annular or open but closeable in a ring by virtue of engagement means such as for example those known by the trade-name Velcro.

Figure 5:
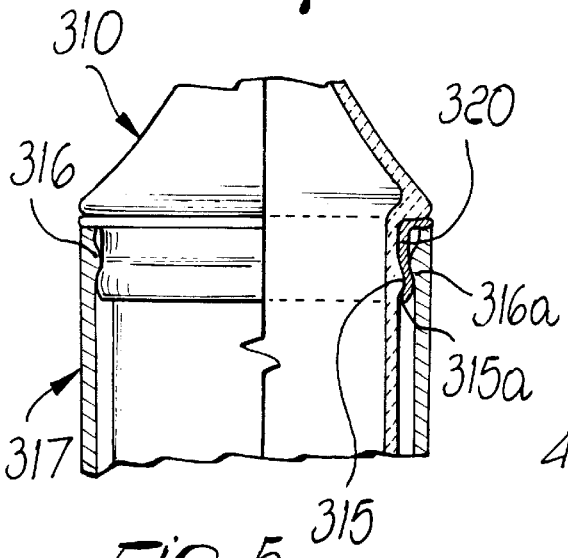

With reference to FIG. 5, in an another embodiment the coupling between the two components of the bottle occurs by snug-fit coupling between two annular arts: an internal one 315 of the first component 310 and n external one 316 of the second component 317, with the interposition of an annular gasket 320 made of plastics.

The two parts have respective undercuts 315*a* and 316*a* which axially grip the gasket 320, which is also subjected to compression with its two coupled parts (its external dimensions are larger than the internal ones of the part 316).

Figure 6:
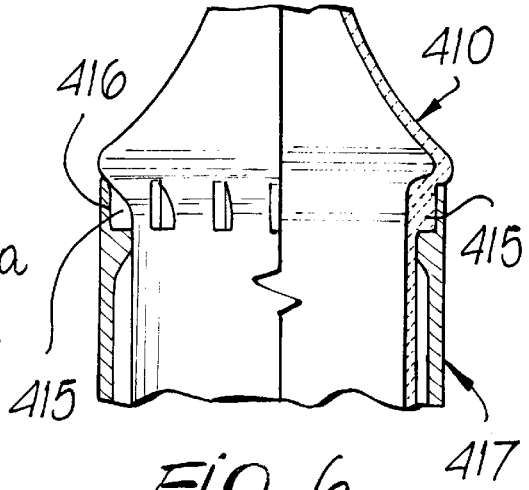

With reference to FIG. 6, in a still different, very convenient embodiment, the coupling between the two components of the bottle is provided by snugly-fitting the radial raised portions 415 which protrude from the first component 410 with the complementarily shaped seats 416 of the second component 417.

The parts are mutually glued or a strap is provided, not shown, similar to said strap 220.

Figure 7:
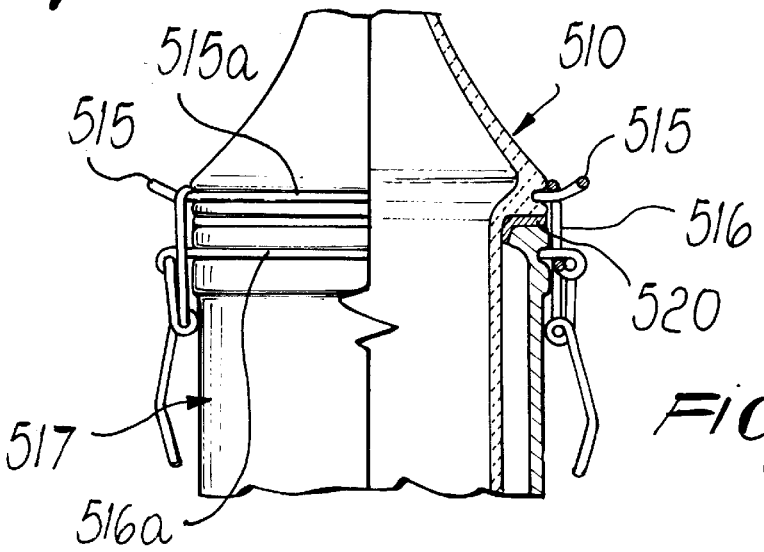

With reference to FIG. 7, in yet another advantageous embodiment the two components of the bottle are coupled through hooks 516 which are articulated to one of the two components, for example to a metal ring 516*a* which is arranged in a corresponding annular groove of the second component 517, which engages the other components, for example tabs 515 which protrude from a metal ring 515*a* which is arranged in a corresponding annular groove of the first component 510.

It is possible to interpose an annular gasket 520, for example made of polymer, between the mutually coupled regions.

In every case, the bottle externally has substantially the same appearance as an ordinary wine or beverage bottle, in which the bottom forms a flat arrangement for resting, but actually the entire region of the cylindrical body is thermally shielded to conveniently slow down the exchange of heat with the outside during drinking at the table after chilling in a refrigerator.

Said shielding is sufficient to keep the content, which is gradually drunk, at an optimum temperature throughout the duration of a meal.

The same situation occurs in any case even if the bottle is meant to contain liquids of other kinds, even nondrinkable ones, which nevertheless need to be kept at low temperature for a long time after preservation.

In practice it has been observed that the intended aim and objects of the present invention have been achieved; a thermally shielded bottle has in fact been provided which is structured so that it does not differ from the shape of current wine bottles and can be produced without difficulty with known technologies (in particular, both components can be made independently with the conventional blowing method).

The use of the bottle according to the invention causes, in the case of wines or other beverages, the convenient elimination of other accessories such as ice buckets and isothermic buckets.

From the producer's advertising viewpoint, the labels and the trademarks remain clearly visible on the table during drinking.

In practice, the materials employed, so long as they are compatible with the contingent use, as well as the dimensions, may be any according to requirements.

What is claimed is:

1. A wine bottle, comprising a first component which forms an inner tubular body with a closed bottom, an upper neck extending from said tubular body with a reduced-tapering diameter to an opening for filling and pouring wine, an enlarged rim being arranged adjacent said opening so as to be adapted to accommodate a cork and, substantially between the body and the neck, an annular region for connection to an upper rim of a second component which is coaxial to the first component and forms an outer tubular body which has a closed bottom and forms an interspace together with the tubular body of the first component, the first component and the second component of the wine bottle being made of glass, and a coupling between said first component and said second component being provided through adhesives or by mutual localized fusion welding of the materials that compose them and providing a hermetic coupling for said interspace at the annular region of said first component and the upper rim of said second component, the bodies of said first component and said second component being substantially cylindrical, and the body of said second component being provided adjacent said upper rim with an annular rim and a step-like recess, and extending from the latter by widening slightly towards the bottom, the diameter at the bottom being equal to the diameter of the annular rim.

2. A bottle according to claim 1, wherein said annular region is a conical annular flared portion, said conical annular flared portion forming, with respect to a plane which is perpendicular to the bottle axis, an angle between 0 and substantially 25 sexagesimal degrees.

3. A bottle according to claim 2, wherein said angle is substantially of 10 sexagesimal degrees.

4. A bottle according to claim 2, wherein said upper rim of said second component is complementarily shaped with respect to said conical annular flared portion of said first component.

5. A wine bottle, comprising a first component which forms an inner tubular body with a closed bottom, an upper neck extending from said tubular body with a reduced-tapering diameter to an opening for filling and pouring wine, an enlarged rim being arranged adjacent said opening so as to be adapted to accommodate a cord and, substantially between the body and the neck, a step-like annular region for connection to an upper rim of a second component, which is coaxial to the first component and forms an outer tubular body which has a closed bottom and forms an interspace together with the tubular body of the first component, the first component and the second component of the wine bottle being made of glass, and a hermetic coupling being provided for said interspace at the annular region of said first component and the upper rim of said second component, said interspace extending between said inner and outer tubular bodies and between said closed bottoms of said inner and outer tubular bodies, said interspace being filled with insulating material.

6. A bottle according to claim 5, wherein the first and second components are mutually joined by gluing.

7. A bottle according to claim 6, wherein the first and second components are mutually joined by elastomeric material.

8. A bottle according to claim 5, wherein at least the closed bottom of the inner tubular body is concave.

9. A bottle according to claim 5, wherein at least the bottom of the outer tubular body forms a flat resting surface.

10. A wine bottle, comprising a first component which forms and inner tubular body with a closed bottom, an upper neck extending from said tubular body with a reduced-tapering diameter to an opening for filling and pouring wine, said opening having a shaped and enlarged rim so as to be adapted to accommodate a cork and, substantially between the body and the neck, a step-like annular region for connection to the upper rim of a second component, which is coaxial to the first one and forms an outer tubular body which has a closed bottom and forms an interspace together with the tubular body of the first component, the first component and the second component of the wine bottle being made of glass, and a hermetic coupling being provided for said interspace at the annular region of said first component and the upper rim of said second component, said interspace extending between said inner and outer tubular bodies and between said closed bottoms of said inner and outer tubular bodies, said interspace being filled with a glycol.

* * * * *